United States Patent [19]

Aldrich

[11] 4,167,604

[45] Sep. 11, 1979

[54] THERMAL INSULATION MATERIAL COMPRISING A MIXTURE OF DOWN AND SYNTHETIC FIBER STAPLE

[75] Inventor: William E. Aldrich, Ashaway, R.I.

[73] Assignee: Warnaco Inc., Bridgeport, Conn.

[21] Appl. No.: 920,706

[22] Filed: Jun. 30, 1978

[51] Int. Cl.[2] ..... A47G 9/00; A47G 9/08

[52] U.S. Cl. ..... 428/359; 428/361; 428/362; 252/62; 267/148

[58] Field of Search ..... 428/361, 362, 288, 359; 5/361 R, 343

[56] References Cited

U.S. PATENT DOCUMENTS

| | | | |
|---|---|---|---|
| 3,772,137 | 11/1973 | Tolliver | 428/398 |
| 4,040,371 | 8/1977 | Cooper et al. | 428/361 |

*Primary Examiner*—J. C. Cannon

*Attorney, Agent, or Firm*—Amster, Rothstein & Engelberg

[57] ABSTRACT

An improved thermal insulation material comprising a carded web containing at least 10% natural down, the balance being crimped, hollow polyester staple. The carded web is uniformly impregnated with a thermosetting resin to form a bat which is employed as a filler for garments, sleeping bags and the like.

9 Claims, No Drawings

THERMAL INSULATION MATERIAL COMPRISING A MIXTURE OF DOWN AND SYNTHETIC FIBER STAPLE

This invention relates to a thermal insulation material for use in parkas, sleeping bags and other articles where maximum thermal insulation, softness, resiliency, lightweight and durability are desired. More particularly, the invention relates to a treated bat of blended synthetic and natural materials exhibiting improved thermal insulation characteristics in addition to the other desired physical characteristics of such materials.

Goose down, duck down and related water fowl feathers, and blends thereof, have long been employed as thermal insulation materials for clothing, sleeping bags and the like. Although down exhibits excellent thermal properties when new, it has a tendency to mat and lose it bulkiness or loft as a result of being subjected to compressive forces encountered under conditions of actual use, particularly if it becomes wet. Polyester fibers have also been employed as garment and sleeping bag insulators. One such synthetic material is described in U.S. Pat. No. 3,772,137 and comprises a polyester pillow bat formed from low denier, crimped, hollow polyester fibers. While the use of such a synthetic material has a significant cost advantage as compared to down, it is generally recognized as being inferior to down with respect to insulating characteristics, softness and weight.

In accordance with the present invention, there is provided a novel insulating material which is a blend of down and synthetic fiber staple formed from hollow polyester filaments. It has been discovered that the thermal insulating characteristics of such a blend is unexpectedly superior to the thermal insulating characteristics of pure down. In a preferred embodiment of the invention, a blend of down and the synthetic fibers is formed into a multiple ply carded web and treated with a thermosetting resin to form a bat which will retain its original loft and thermal insulating characteristics.

The synthetic hollow polyester fibers which are employed in the improved thermal insulation material of the invention are well-known in the art and are described, for example, in U.S. Pat. No. 3,772,137. The preferred fibers are formed from polyethylene terephthalate, although other polyester materials as described in the foregoing prior art patent or otherwise known in the art may be employed. The fiber is crimped and has a denier per filament within the range of 3 to 6. The crimped, hollow polyester filaments are converted to staple having a length in the range of 1⅛ to 2½ inches prior to use in the formation of the insulation material of the invention. Although not essential to the invention, the polyester staple may be treated with a durable silicone lubricant, such as hydrogen methylpolysiloxane or the like, in order to maximize the movement of the fibers and promote formation of a uniform blend with the down component.

Ordinarily, the polyester staple is garnetted and is then blended with the down to form a mixture. Although the relative amounts of down and polyester staple may be varied over substantially broad limits, it has been found that at least 10 wt.% down must be employed in order to achieve the superior thermal insulation characteristics of the material of the invention. In the preferred form of the invention, 10 wt.% down is blended with 90 wt.% of polyester staple. However, amounts of down ranging from 10 to 60 wt.% and, preferably, 10 to 15 wt.% can also be employed.

The blend of polyester staple and down is formed into a carded web employing conventional carding equipment which is well-known to persons of ordinary skill in the art. The carding operation serves to uniformly blend the down and synthetic fiber staple. The carded web will ordinarily have a thickness in the range of ¼ to ½ inch, but may be built-up in multiple plies to produce a web having a thickness of one inch or more, depending upon the desired end use of the material. While the web thus formed will exhibit a high degree of bulkiness or loft, as well as excellent thermal insulation qualities, it does not have a great amount of structural strength. Accordingly, in a preferred embodiment of the present invention, the web after being built-up into the desired thickness, is treated so as to uniformly impregnate the web with a film-forming, thermosetting resin capable of forming a relatively rigid, nontacky structure after curing. The treated web or batting possesses sufficient structural strength to permit normal handling during the manufacture of garments and also has the ability to withstand compressive forces encountered during use of garments or sleeping bags which would have a tendency to cause the batting to permanently mat down and reduce its insulating ability.

In a preferred embodiment, the uniform impregnation of the thermosetting resin is achieved by forming a dilute solution of the resin and applying it to the web through a series of spray nozzles maintained at a pressure which ensures a fine, even and thorough penetration of the resin solution throughout the thickness of the multiple ply webbing, rather than the formation of a surface "skin" or film. A typical resin solution would consist of 5 to 25 wt.%, preferably 10 to 15 wt.%, of a melamine formaldehyde resin, e.g., trimethylol melamine formaldehyde; 0.75 to 3.75 wt.%, of preferably 1.5 to 2.25 wt.% of a curing agent for the selected resin, e.g., zinc nitrate; and 71.25 to 94.25 wt.%, preferably 88.5 to 82.75 wt.% water. Other thermosetting, film-forming resins capable of forming a hard, non-tacky film after curing may be employed in lieu of the melamine-formaldehyde resin. Ordinarily, the amount of resin solution applied amounts to 5 to 10 wt.%, e.g., 8 wt.%, on a solids basis, of the final product.

The resin treated web will be subjected to heat curing prior to use. Typically, curing will be carried out in an oven maintained at a temperature of 250° to 325° F., e.g., 275° F., for a time ranging from 3 to 8 minutes, e.g., 5 minutes. Upon completion of the curing step, the batting is handled in the same manner as are conventional battings employed in garment manufacture.

The invention will be further understood by reference to the following illustrative example.

EXAMPLE 1

A crimped, hollow polyester filament commercially manufactured by du Pont and sold under the trademark "Hollofil" which has been treated with a hydrogen methylpolysiloxane lubricant was cut into staple having an average length of 2½ inches. The polyester staple was subjected to a conventional garnetting operation to break apart the staple. Thereafter, 10 wt.% of goose down was mixed with the treated polyester staple. The mixture was then carded in conventional equipment for that purpose to produce a web having the down uniformly dispersed therein.

The carded web formed as described above was built-up in multiple plies until it was approximately $\frac{7}{8}$ inch thick. Thereafter the multiple ply web was moved on a conveyor belt beneath a series of spray heads operating at a pressure sufficient to cause a uniform mist of a resin solution consisting of 10.0 wt.% trimethylolmelamine formaldehyde, 1.5 wt.% zinc nitrate and 88.5 wt.% water to uniformly penetrate the web. The treated batting was passed through a curing oven where it was held for approximately 5 minutes at a temperature of 275° F. to cure the thermosetting resin. The batting produced in the foregoing operation contained 8 wt.% resin on a solids basis.

In order to evaluate the insulating qualities of the treated batting of this invention, a series of identical vests were made in which the only difference was the nature of the insulation material in each vest. Each of these vests were subjected to a test involving the use of a copper mannequin which is capable of measuring the time rate of transfer of heat by conductance through a unit of thickness across a unit area for a unit difference of temperature. In fact, the copper mannequin is equipped with thousands of thermistors capable of recording the temperature change over the entire garment area when the mannequin is heated and automatically calculating the average insulation value per square inch of garment area; per inch of insulation thickness; and per ounce of insulation thickness. These measurements are expressed in CLO units which, in essence, are the reciprocal of the insulation value and are defined by the following equation: CL0=mass×time/energy×a constant for the particular insulation material being tested.

The average CLO values for identical vests containing (a) the batting of this invention; (b) 180 grams of down; and (c) 213 grams of down were compared in new garments, as well as in garments which had undergone three (3) laundry cycles. The amounts of down were selected based upon amounts which were known to have been employed in commercial garments. The results of the tests were as follows:

| Vests | Average CLO Before Laundering | Average CLO After Laundering |
|---|---|---|
| Treated Bat | 4.13 | 4.16 |

-continued

| Vests | Average CLO Before Laundering | Average CLO After Laundering |
|---|---|---|
| 180 Down | 3.13 | 3.09 |
| 213 Down | 3.53 | 3.47 |

The tests showed that the treated bat of the invention exhibits an insulation value which is substantially superior to natural down and that this insulation value is retained through the laundry cycle.

What is claimed is:

1. A thermal insulation material comprising a batting, said batting being formed from a carded web containing at least 10 wt.% natural down and a synthetic fiber staple, said synthetic fiber staple being formed from crimped, hollow polyester fibers.

2. The material of claim 1, further including a thermosetting resin being uniformly dispersed therein.

3. The material of claim 2, wherein said thermosetting resin is trimethylol melamine formaldehyde.

4. The material of claim 2, wherein the resin constitutes 5 to 10 wt.% of the finished material.

5. A thermal insulation material comprising a treated batting, said batting being formed from a carded web, said web being a mixture of 10 to 50 wt.% natural down and 90 to 40 wt.% of a crimped polyester fiber staple having an average length of $1\frac{1}{8}$ to $2\frac{1}{2}$ inches, said polyester fiber staple being formed from hollow filaments having a denier of 3 to 6 per filament, said batting being formed by uniformly impregnating said carded web with a thermosetting resin.

6. The insulation material of claim 5, wherein the thermosetting resin is trimethylol melamine formaldehyde.

7. The insulation material of claim 6, wherein said thermosetting resin is applied to said webbing as a curable aqueous solution.

8. The insulating material of claim 6, wherein said formaldehyde resin constitutes 8 wt.%, on a solids basis, of the batting.

9. A thermal insulation material comprising a treated batting, said batting being formed from a carded web, said web containing at least 10 wt.% natural down and a polyester fiber staple, said polyester fiber staple being formed from hollow filaments having a denier of 3 to 6 per filament, said batting being formed by uniformly impregnating said carded web with trimethylol melamine formaldehyde resin.

* * * * *